US011745234B2

(12) United States Patent
Diehl et al.

(10) Patent No.: US 11,745,234 B2
(45) Date of Patent: Sep. 5, 2023

(54) ROLLING DEVICE

(71) Applicant: SMS group GmbH, Düsseldorf (DE)

(72) Inventors: Christian Diehl, Hilchenbach (DE); Jörn Sohler, Kreuztal (DE); Achim Klein, Kreuztal (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 17/795,598

(22) PCT Filed: Dec. 11, 2020

(86) PCT No.: PCT/EP2020/085769

§ 371 (c)(1),
(2) Date: Jul. 27, 2022

(87) PCT Pub. No.: WO2021/151571

PCT Pub. Date: Aug. 5, 2021

(65) Prior Publication Data

US 2023/0076364 A1 Mar. 9, 2023

(30) Foreign Application Priority Data

Jan. 29, 2020 (DE) ..... 10 2020 201 071.4
May 14, 2020 (DE) ..... 10 2020 206 123.8

(51) Int. Cl.
*B21B 31/32* (2006.01)
*B21B 31/20* (2006.01)

(52) U.S. Cl.
CPC ..... *B21B 31/203* (2013.01); *B21B 31/32* (2013.01)

(58) Field of Classification Search
CPC ..... B21B 29/00; B21B 31/203; B21B 31/32; B21B 37/38; B21B 2269/02; B21B 2269/04; B21B 31/20
(Continued)

(56) References Cited

U.S. PATENT DOCUMENTS 3,610,013 A 10/1971 Pillon
3,651,675 A * 3/1972 Stone ..... B21B 29/00 72/241.8
(Continued)

FOREIGN PATENT DOCUMENTS

DE 1452153 U 12/1968
DE 3918242 A1 12/1990
(Continued)

OTHER PUBLICATIONS

DE 19536042A1, Kuehn Apr. 1997.*
JP 60-141317A, Ide Jul. 1985.*

*Primary Examiner* — Edward T Tolan
(74) *Attorney, Agent, or Firm* — Smartpat PLC

(57) ABSTRACT

A rolling device has an upper and a lower work roll and at least one upper and one lower backup roll. The work rolls and the backup rolls are supported on a common rolling mill stand. The work rolls can be adjusted relative to each other in order to adjust a specified rolling gap. Each of the work rolls is operatively connected to at least one bending device. At least one first bending device is paired with die upper work roll, and at least one second bending device is paired with the lower work roll. The second bending device comprises bending cylinders which are arranged in a vertically fixed manner. The upper work roll can be readjusted or carried by the first bending device, thereby vertically adjusting die height of the rolling gap. The first bending device comprises bending arms that interact with bending cylinders arranged in a stationary manner.

12 Claims, 5 Drawing Sheets

(58) Field of Classification Search
USPC ..... 72/241.8
See application file for complete search history.

(56) References Cited

U.S. PATENT DOCUMENTS

| | | | | | |
|---|---|---|---|---|---|
| 3,659,450 | A * | 5/1972 | Metzger | B21B 29/00 | 72/248 |
| 4,803,865 | A * | 2/1989 | Jansen | B21B 29/00 | 72/247 |
| 6,170,311 | B1 | 1/2001 | Daub | | |
| 9,308,562 | B2 * | 4/2016 | Diehl | B21B 29/00 | |
| 2011/0239723 | A1 | 10/2011 | Diehl et al. | | |
| 2022/0118493 | A1 * | 4/2022 | Dorigo | B21B 31/22 | |

FOREIGN PATENT DOCUMENTS

| | | | |
|---|---|---|---|
| DE | 102005042069 | A1 | 3/2007 |
| EP | 2342026 | B1 | 7/2012 |
| JP | S49059755 | A | 6/1974 |
| JP | S5680308 | A | 7/1981 |
| JP | S59130607 | U | 9/1984 |
| JP | S6099405 | A | 6/1985 |
| JP | 2000024710 | A | 1/2000 |
| JP | 2012143790 | A | 8/2012 |
| JP | 2012157876 | A | 8/2012 |

* cited by examiner

ROLLING DEVICE

TECHNICAL FIELD

The disclosure relates to a rolling device comprising at least one upper and one lower work roll and comprising at least one upper and one lower backup roll.

BACKGROUND

A rolling device of the type described above is known, for example, from EP 2 342 026 B1. EP 2 342 026 B 1 describes a rolling device with work roll bending and balancing cylinders. The bending cylinders for the lower work roll are arranged vertically in stationary blocks. The bending device for the upper work roll is characterized by bending arms that can be moved vertically in guides on the housing. The bending cylinders are guided within the window of the housing below its crosshead on balancer arms of the upper backup roll via crossbars on balancer arms. That is, they are moved together with the backup roll balancers when the upper rolls are positioned. A vertical force is applied to the chocks of the upper work roll via the bending arms, which are hooked into the crossbars. This rolling device provides a work roll-axial displacement and bending device, with which a very high roll lift of up to about 1100 mm can be realized.

However, the work roll-axial displacement and bending device described in EP 2 342 026 B1 has the disadvantage that, when the upper bending cylinders are actuated to influence the rolling gap contour, interactions with the upper backup roll balancer can occur. At least, it is necessary to make the cylinder of the upper backup roll balancer much stronger so that no negative effects can be caused on the roll gap contour. The components arranged in the force flow with the upper backup roll-balancer must be designed to absorb relatively high forces.

Further prior art is known from the publications JPS6099405 A and JPS59130607 and JP 2012143790.

SUMMARY

The disclosure is based on the object of providing a rolling mill stand of the type mentioned above, which enables a very high roll lift while avoiding undesirable interactions with the backup roll balancer. In particular, the disclosure is based on the object of implementing a work roll bending device on a rolling mill stand of the type mentioned at the beginning, which enables good guidance of the work roll chocks in the stand window at maximum to minimum roll diameters and at a maximum and minimum roll lift. In particular, the advantages described above should also be realizable with a rolling device with a work roll axial displacement device.

The object underlying the invention is achieved by the features of the independent claim. Advantageous embodiments of the subject matter of the invention arise from the dependent claims.

A rolling device is provided with at least one upper and one lower work roll and with at least one upper and one lower backup roll. The work rolls and the backup rolls are supported on a common rolling mill stand. The work rolls can be adjusted relative to each other in order to adjust a specified rolling gap and each of the work rolls is operatively connected to at least one bending device. A first bending device is paired with the upper work roll and a second bending device is paired with the lower work roll. The second bending device comprises bending cylinders that are arranged in a vertically fixed manner. The upper work roll can be readjusted or carried by the first bending device for vertical adjustment of the height of the rolling gap between the rolling passes. The first bending device comprises bending arms that interact with bending cylinders arranged in a stationary manner.

A bending arm is a connecting element that bridges a spatial separation from the bending cylinder to the point of action of the bending force on the work roll chocks. Due to the structural and spatial separation of the first bending device from the second bending device, a particularly high roll lift of at least 900 mm, preferably 1200 mm, particularly preferably 1350 mm, can be made possible.

For the carrying of the upper work roll during the adjustment of the rolling gap, the stroke of the first bending device follows the travel path of the vertical adjustment of the height of the rolling gap, such that contact between the upper work roll and the upper backup roll is ensured for the rolling operation. Thereby, the first bending device is structurally separate from a roll adjustment device.

A decoupling of the bending device for the upper work roll from a balancing system for the upper backup roll is substantially provided. The fact that the bending cylinders of the first bending device are arranged in a vertically fixed manner and preferably well above the work roll chocks ensures a relatively high roll lift with good guidance of the work roll chocks in the stand window. The decoupling simplifies the accessibility of the two devices for maintenance purposes.

It is expedient that the bending arms of the first bending device carry the upper work roll if the height of the rolling gap is adjusted vertically.

The height of the rolling gap is preset prior to the commencement of rolling (rolling pass). For this purpose, an overhead roll adjustment device moves the upper backup roll to the position in which it is held by the backup roll balancer against the weight force. The upper work roll follows this vertical movement, whereby it is held by the arms of the bending device. The bending cylinders and thus the upper work roll as well initially follow the movement of the upper backup roll between the rolling passes. An additional stroke of the bending cylinders causes bending of the work roll and thus the desired influence on the contour of the rolling gap during the pass.

In a preferred embodiment of the rolling device, it is provided that the work rolls are axially and vertically adjustable.

The stationary mounting of the bending cylinders of the first, upper bending device is particularly advantageous in conjunction with an axial adjustment of the work rolls, because with this arrangement the structurally and spatially separate backup roll balancer is not additionally subjected to the reaction forces resulting from the bending of the work rolls.

Preferably, at least one axial displacement device is provided for at least one of the work rolls. The axial displacement device, for example of the upper work roll, can be arranged in a manner that is stationary on the housing or cantilevered.

In an advantageous variant of the rolling device, it is provided that at least one axial displacement device is operatively connected to the bending arms of the first bending device. The operative connection can be achieved via a direct connection between bending arms and the axial displacement device. Indirect connections, for example via further latches or guides, also ensure an operative connection.

The bending cylinders of the second bending device can be arranged vertically in stationary blocks and act on work roll chocks of the lower work rolls.

With a variant of the rolling device, it is provided that the bending cylinders of the second bending device are arranged in thickenings of a housing of the rolling mill stand.

Preferably, the bending cylinders of the first bending device, i.e. the bending device that drives the upper roll assembly (upper work roll and upper backup roll), are each supported on an upper crosshead of a housing of the rolling mill stand. Such a high arrangement of the bending cylinders ensures a relatively large adjustment travel for the upper roll arrangement.

For example, the bending cylinders of the first bending device can dip into recesses of the upper crosshead of the housing of the rolling mill stand.

Alternatively, the bending cylinders of the first bending device can each be attached to an outer side of the housing of the rolling mill stand.

The bending arms of the first bending device are preferably guided vertically in recesses of the rolling mill stand by means of guide elements, preferably each within the stand window of a housing.

The bending arms of the first bending device, by means of correspondingly formed thickenings at their ends, can engage under the work roll chocks of the upper work roll.

Alternatively, it can be provided that the bending arms of the first bending device are provided with recesses that completely engage around a corresponding contour of the work roll chocks of the upper work roll. In this manner, both positive and negative work roll bending can be realized.

With the rolling device, the upper backup roll is preferably supported at each of its ends in a backup roll chock, which is operatively connected to balancing cylinders that compensate for the dead weight of the backup roll.

The invention is explained below with reference to the accompanying drawings by exemplary embodiments.

DETAILED DESCRIPTION

Figure 1:
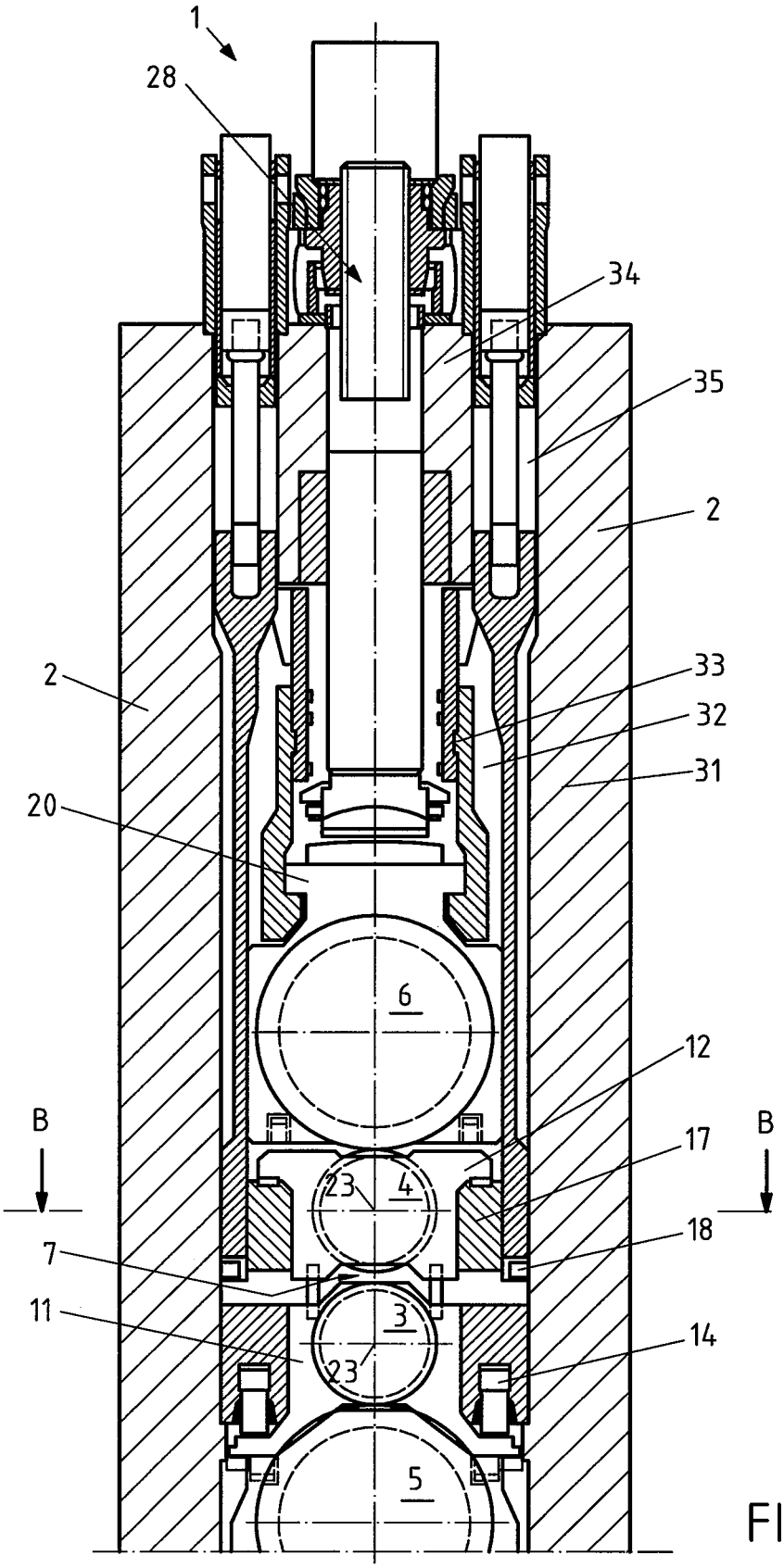
FIG. 1 shows a longitudinal section through a rolling device in accordance with a first exemplary embodiment with a pair of work rolls and a pair of backup rolls.

Reference is first made to FIG. 1. FIG. 1 shows a rolling device 1. The rolling device 1 comprises a rolling mill stand 2 with two work rolls, 3 and 4 and two backup rolls 5, 6. The rolling mill stand 2 described in the exemplary embodiments is designed as a four-high rolling mill stand, but it can also have a different configuration. A rolling gap 7 is formed between the work rolls 3, 4, into which the rolled material is drawn during the operation of the rolling device 1. With the rolling device 1, the height 8 of the roll gap 7, which is also referred to as the roll lift, is adjustable, namely via an upper roll adjustment device 28 and, if necessary, a lower roll adjustment device. In addition, the work rolls 3, 4 are also axially adjustable, as will be described below, such that the contour of the rolling gap 6 can also be influenced via the axial adjustment of the work rolls 3, 4 relative to each other.

The work rolls 3, 4 and the backup rolls 5, 6 are held in a rolling mill stand 2, which comprises two housings 31, one on the operating side and one on the drive side. The housings 31 are designed as closed frames in which all rolling forces are kept in balance by internal forces. The rolling mill stand 2 accommodates backup roll chocks 9, 10 and work roll chocks 11, 12, each of which is slidably arranged within windows 32 formed by the housing. The backup roll chocks 9, 10 support the lower and upper backup rolls 5, 6, wherein the backup roll chock 10 shown in the drawing supports the upper backup roll 6 and the backup roll chock 9 supports the lower backup roll 5.

Work roll chocks 11, 12 are arranged between the backup roll chocks 9, 10, within which the work rolls 3, 4 are supported. The upper work roll chock 12 supports the upper work roll 4, whereas the lower work roll chock 11 supports the lower work roll 3.

The work roll chocks 11, which accommodate the lower work roll 3, are slidably arranged in stationary blocks 13. The blocks 13 accommodate bending cylinders 14 in order to be able to bend the lower work roll 3. The bending cylinders 14, which act on the work roll chocks 11 for the lower work roll 3, are part of the second, lower bending device. As an alternative to the blocks, the rolling mill stand 2 can also have thickenings to accommodate the bending cylinders 14.

The backup roll chock 10 for the upper backup roll 6 is engaged by balancing arms 33, via which the dead weight of the backup roll with its chocks 6 can be compensated by means of balancing cylinders. For this purpose, the balancer arms 33 are equipped with hook-shaped thickenings which engage under corresponding projections of the backup roll chock 10.

The work roll bending and/or work roll balancing of the upper work roll 4 is realized via bending cylinders 15, which are operatively connected to the upper work roll 4 via bending arms 16. The bending cylinders 15 and the bending arms 16 are part of the first, upper bending device. The bending cylinders 15 are fixed to an upper crosshead 34 of the housing 2 or supported on the upper crosshead 34 of the housing 2 and pass through recesses 35 of the housing 2. The bending cylinders 15 extend substantially vertically. In extension of the bending cylinders 15, the bending arms 16 are attached to them, each of which bending arms has thickenings 17 at the lower end. The thickenings 17 of the bending arms 16 engage under lateral ear-shaped projections of the work roll chock 12 of the upper work roll 4.

The bending cylinders are preferably designed for a large stroke, which exceeds the roll grinding plus the roll lift.

The bending arms 16 are guided vertically by guide elements 18 in recesses 36 of the rolling mill stand 2 or of the housing 31 of the rolling mill stand 2, as the case may be. The upper work roll 4 and the upper backup roll 6 are carried by the bending arms 16, which engage under the work roll chock 12 with the thickenings 17, if the height 8 of the rolling gap 7 is adjusted.

The bending cylinders 14, 15 act on the outer edge regions of the work rolls 3, 4 and thus exert a force in the edge region of the work rolls 3, 4 directed vertically outward from the rolling gap 7 corresponding to the force of the rolled material effective in the central region of the work rolls 3, 4 in order to counteract a bending apart of the work rolls 3, 4 by the rolled material.

With the first exemplary embodiment of the invention shown in FIG. 1, the bending cylinders 14, 15 serve to achieve a so-called "positive work roll bending." Additional piston-cylinder systems 19, 20, each acting vertically, are provided to increase the adjustment range for profile influencing through so-called "negative work roll bending."

Figure 4:
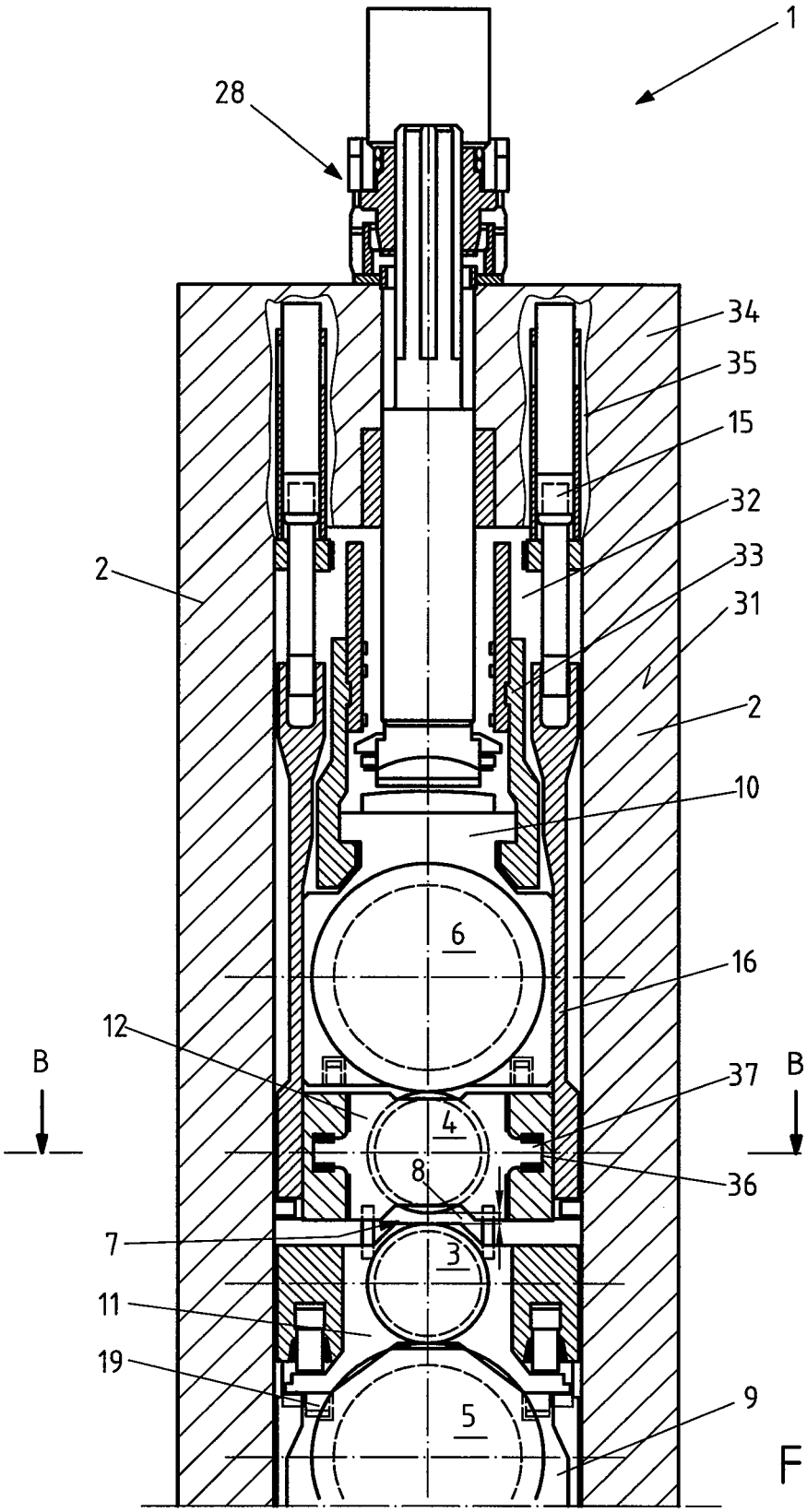
FIG. 4 is a longitudinal section through a rolling device in accordance with a second exemplary embodiment.

FIG. 4 shows a second exemplary embodiment of the rolling device. Identical components are marked with the same reference signs. In contrast to the exemplary embodiment in accordance with FIG. 1, the bending cylinders 15 of the first, upper bending device partially dip from below into the upper region of the window 32 in quiver-shaped recesses 35 of the upper crosshead 34 of the rolling mill stand 2.

The exemplary embodiment in accordance with FIG. 4 further differs from that of FIG. 1 in that window-like recesses 36 are provided in the bending arms 16, in which recesses correspondingly designed rails 37 of the work roll chocks 12 for the upper work roll 4 engage. Thus, the work roll chocks 12 for the upper work roll 4 are fixed in vertically opposite directions, such that the upper work roll 4 can be bent both positively and negatively by means of the bending cylinders 15.

Figure 5:
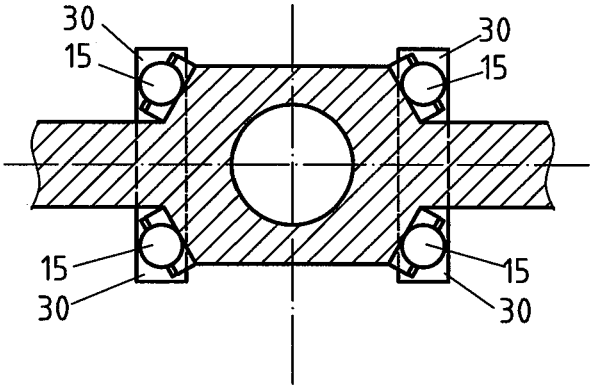
FIG. 5 shows a cross-section through the upper crosshead of the housing of the rolling device in FIG. 4, which illustrates an alternative embodiment of the attachment of the bending cylinders of the upper bending device.

FIG. 5 shows an alternative variant of the stationary attachment of the bending cylinders 15 at the rolling mill stand 2. Here, a plurality of bending cylinders 15 is arranged on the outside of the housing 31 of the rolling mill stand 2 and each act on extensions 30 of the bending arms 16.

The rolling device 1 also comprises axial displacement devices 21, each of which is arranged at the outer edge regions of the work rolls 3, 4.

The axial displacement devices 21 for the axial displacement of the work rolls 3, 4 are provided on the work roll chocks 11, 12 on the operating side and comprise hydraulically actuated piston-cylinder units. Thereby, in each case, the piston of the piston-cylinder unit is connected to retaining arms 24 guided in the corresponding chocks. Interlocks arranged on the outer side of the two struts of the housing 31 on the operating side prevent the horizontal movement of the retaining arms 24 and thus the axial movement of a piston 22 of the piston-cylinder unit during rolling operation. By applying pressure on the piston side or the rod side of the piston-cylinder unit, an axial displacement of the work rolls 3, 4 supported in the work roll chocks 11, 2 is realized.

Figure 2:
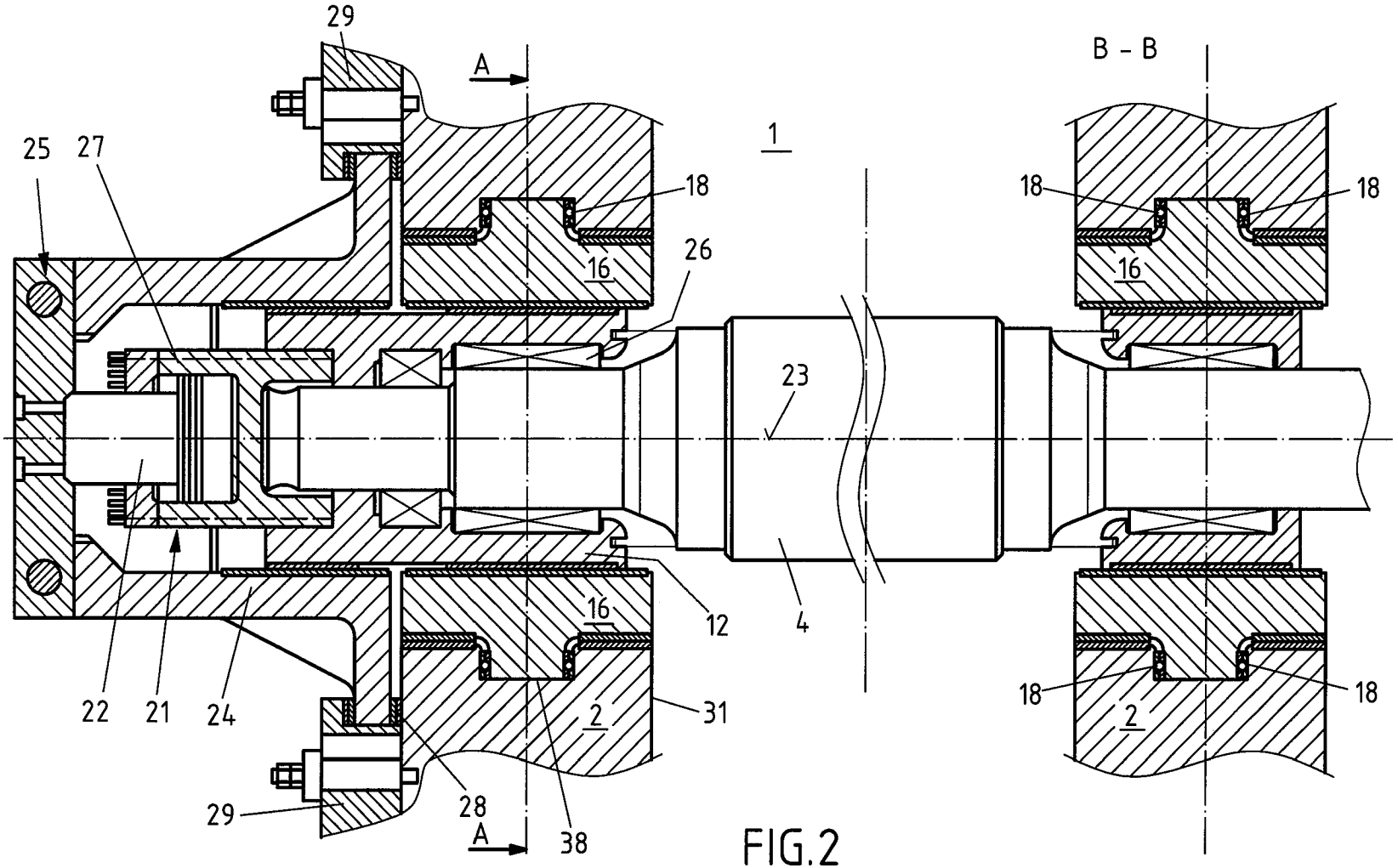
FIG. 2 shows a cross-section along line B-B in FIG. 1, which shows a first variant of an axial displacement device for the upper work roll.

FIG. 2 shows a cross-section through the rolling device 1 in accordance with FIG. 4, along the lines B-B in FIG. 4, illustrating the structure of an axial displacement device 21 and its interaction with the upper work roll 4. The axial displacement device 21 comprises at least one hydraulic acting piston 22, which is arranged on the retaining arms 24 via an abutment 25. The retaining arms 24 are arranged in a horizontal sliding manner in the work roll chocks 11, 12 and are engaged around by lateral retaining devices 29, which are fixed on the outer side of the rolling mill stand 2 and prevent the horizontal movement of the retaining arms 24 in the direction of the roll axis 23. This also fixes the piston 22 of the axial displacement devices 21 in the axial direction. The retaining arms 24 are movable in the vertical direction in the lateral retaining devices 29.

From the cross-section shown in FIG. 2, the interaction of the guide elements 18 of the profiled outer sides of the bending arms with correspondingly formed guide grooves 38 of the housing 31 or the struts of the housing 31 can also be seen.

Figure 3:
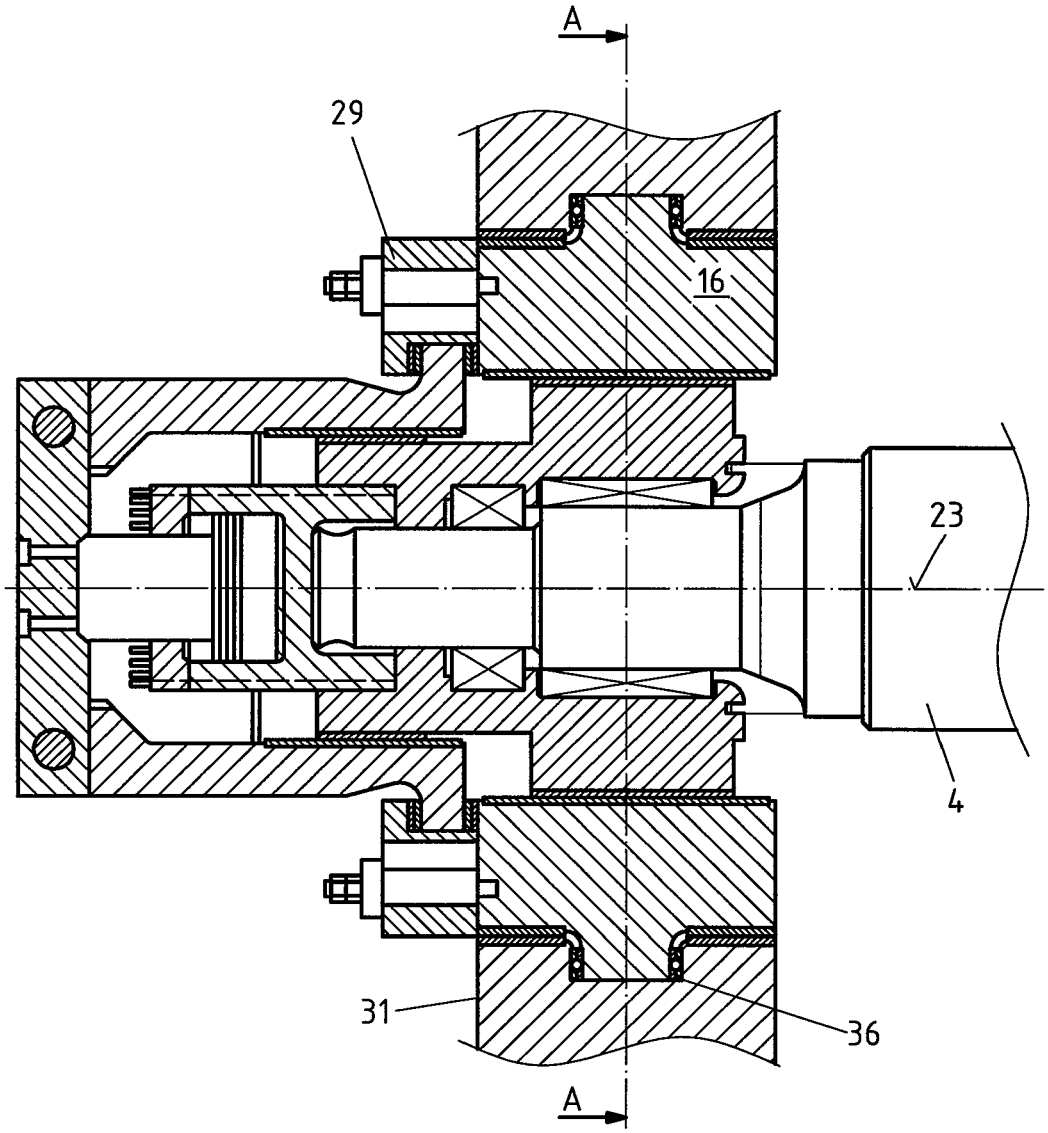
FIG. 3 is a view corresponding to FIG. 2, which shows a second variant of an axial displacement device for the upper work roll.

FIG. 3 shows an alternative embodiment of the axial displacement devices 21. Identical components are marked with the same reference signs in FIG. 3. The axial displacement device 21 in accordance with FIG. 3 differs from that of FIG. 2 in that the retaining devices 29 are attached to the bending arms 16 and are thus carried when the height 8 of the rolling gap 7 is adjusted.

Figure 6:
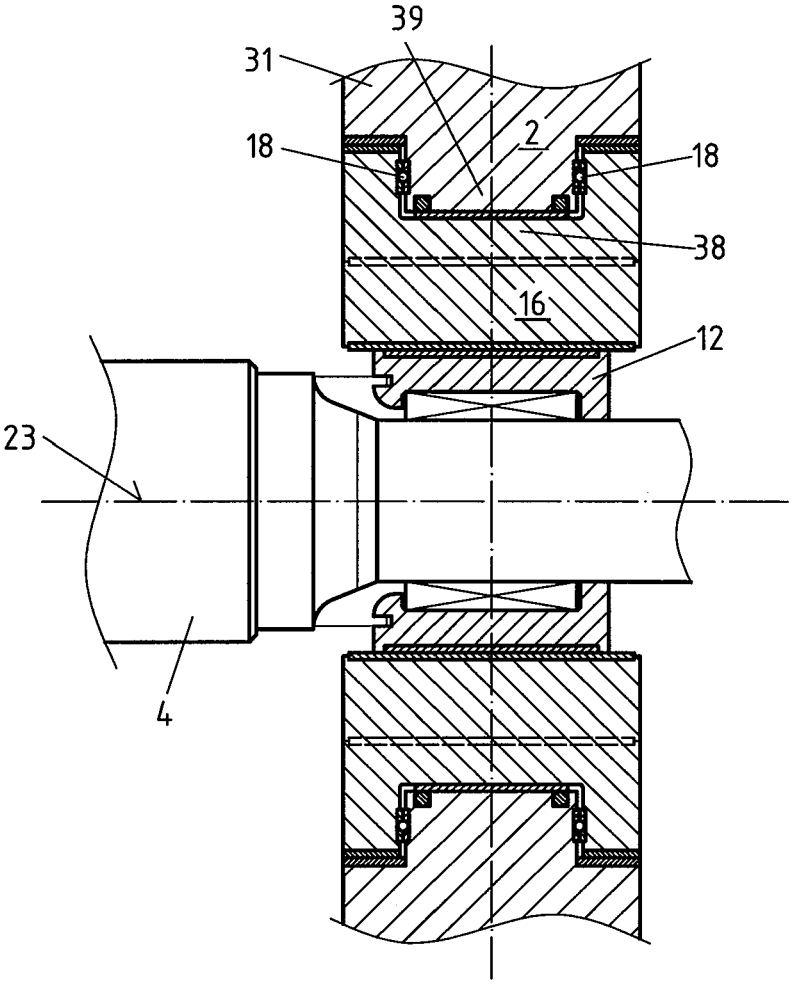
FIG. 6 shows a cross-section along line B-B in FIG. 4.

FIG. 6 shows an alternative embodiment for guiding the bending arms 16 within the rolling mill stand. On their sides turned to the struts of the housing 31, the bending arms 16 are provided with guide grooves 38, which engage around a corresponding guide profile 39 of the struts of the housing 31.

The articles "a" and "an" as used in this application should generally be construed to mean "one or more" unless specified otherwise or clear from context to be directed to a singular form.

| LIST OF REFERENCE SIGNS | |
|---|---|
| 1 | Rolling device |
| 2 | Rolling mill stand |
| 3 | Lower work roll |
| 4 | Upper work roll |
| 5 | Lower backup roll |
| 6 | Upper backup roll |
| 7 | Rolling gap |
| 8 | Height of the rolling gap |
| 9 | Backup roll chock |
| 10 | Backup roll chock |
| 11 | Work roll chock |
| 12 | Work roll chock |
| 13 | Bending block |
| 14 | Bending cylinder of lower work roll |
| 15 | Bending cylinder of upper work roll |
| 16 | Bending arms |
| 17 | Thickening of the bending arm |
| 18 | Guide element |
| 19 | Piston-cylinder system |
| 20 | Piston-cylinder system |
| 21 | Axial displacement device |
| 22 | Piston |
| 23 | Axis of the work roll |
| 24 | Retaining arm |
| 25 | Abutment |
| 26 | Mounting |
| 27 | Cylinder housing |
| 28 | Upper roll adjustment device |
| 29 | Lateral retaining device |
| 30 | Extension of bending arm |
| 31 | Housing |
| 32 | Window |
| 33 | Balancing arms of upper backup roll |
| 34 | Crosshead |
| 35 | Recesses - crosshead |
| 36 | Recesses - housing |
| 37 | Rails |
| 38 | Guide grooves |
| 39 | Guide profile |

The invention claimed is:

1. A rolling device, comprising:

work rolls, including an upper work roll and a lower work roll; and backup rolls, including an upper backup roll and a lower backup roll, wherein the work rolls and the backup rolls are supported in a rolling mill stand, wherein the work rolls can be adjusted relative to each other in order to adjust a rolling gap, wherein each of the work rolls is operatively connected to a bending device, wherein a first bending device is paired with the upper work roll, wherein a second bending device is paired with the lower work roll, wherein the second bending device comprises bending cylinders which are arranged in a vertically fixed manner, wherein the upper work roll can be readjusted or carried by the first bending device, thereby vertically adjusting a height of the rolling gap, wherein the first bending device comprises bending arms that interact with bending cylinders arranged in a stationary manner, and wherein the bending cylinders of the first bending device are supported on an upper crosshead of a housing of the rolling mill stand.

2. The rolling device according to claim 1, wherein the bending arms of the first bending device carry the upper work roll if the height of the rolling gap is adjusted.

3. The rolling device according to claim 1, wherein the work rolls are axially and vertically adjustable.

4. The rolling device according to claim 1, further comprising at least one axial displacement device for at least one of the work rolls.

5. The rolling device according to claim 4, wherein the at least one axial displacement device is operatively connected to the bending arms of the first bending device.

6. The rolling device according to claim 1, wherein the bending cylinders of the second bending device are arranged vertically in stationary blocks and act on work roll chocks of the lower work roll.

7. The rolling device according to claim 1, wherein the bending cylinders of the second bending device are arranged in thickenings of the housing of the rolling mill stand.

8. The rolling device according to claim 1, wherein the bending cylinders of the first bending device dip into recesses of the upper crosshead of the housing of the rolling mill stand.

9. The rolling device according to claim 1, wherein the bending cylinders of the first bending device are each attached to an outer side of the housing of the rolling mill stand.

10. The rolling device according to claim 1, wherein the bending arms of the first bending device engage under work roll chocks of the upper work roll by correspondingly formed thickenings at their ends.

11. The rolling device according to claim 1, wherein the bending arms of the first bending device are provided with recesses that engage around a corresponding contour of work roll chocks of the upper work roll.

12. The rolling device according to claim 1, wherein the upper backup roll is supported at each of its ends in a backup roll chock, and wherein the backup roll chocks are operatively connected to balancing cylinders that compensate for the dead weight of the upper backup roll.

* * * * *